US007563145B2

(12) United States Patent
Lins et al.

(10) Patent No.: US 7,563,145 B2
(45) Date of Patent: Jul. 21, 2009

(54) PLUG-TYPE CONNECTOR HAVING A CONTACT CHAMBER FOR A CONTACT PARTNER AND A TEST SLOT IN THE CONTACT CHAMBER

(75) Inventors: Wilfried Lins, Nofels (AT); Egon Lang, Rothis (AT); Arno Dohr, Schwarzbach (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 0 days.

(21) Appl. No.: 11/788,380

(22) Filed: Apr. 19, 2007

(65) Prior Publication Data

US 2008/0014802 A1 Jan. 17, 2008

(30) Foreign Application Priority Data

Apr. 22, 2006 (DE) ..... 10 2006 018 756

(51) Int. Cl.
*H01R 13/40* (2006.01)

(52) U.S. Cl. ..... 439/752; 439/912

(58) Field of Classification Search ..... 439/752, 439/912, 488, 595
See application file for complete search history.

(56) References Cited

U.S. PATENT DOCUMENTS

| | | | | |
|---|---|---|---|---|
| 6,276,964 | B1 * | 8/2001 | Shinozaki | 439/595 |
| 6,589,079 | B2 * | 7/2003 | Kashiyama et al. | 439/595 |
| 6,736,683 | B2 * | 5/2004 | Brand et al. | 439/828 |
| 6,814,627 | B2 * | 11/2004 | Yamamoto et al. | 439/701 |
| 7,014,511 | B2 * | 3/2006 | Sagawa et al. | 439/752 |

* cited by examiner

*Primary Examiner*—Gary F. Paumen
(74) *Attorney, Agent, or Firm*—Andrew Wilford

(57) ABSTRACT

A plug-type connector having a plastic housing having at least one contact chamber in which a contact is fitted and locked at least at one location. The contact chamber in the housing has on each of two inner faces of the contact chamber a test slot that can receive a test probe that is inserted into the contact chamber for a function test of the plug-type connector.

4 Claims, 1 Drawing Sheet

PLUG-TYPE CONNECTOR HAVING A CONTACT CHAMBER FOR A CONTACT PARTNER AND A TEST SLOT IN THE CONTACT CHAMBER

FIELD OF THE INVENTION

The invention relates to a plug-type connector having a plastic housing with at least one contact chamber in which a contact, in particular a sleeve contact, is fitted and locked at least at one location.

BACKGROUND OF THE INVENTION

Plug-type connectors having a housing made of plastic and having at least one contact chamber in which a contact partner, in particular a socket contact, is situated that is inserted into the contact chamber and locked at least once, are known for applications in the automotive industry, for example. Such plug-type connectors, in particular multi-row plug-type connectors, are mass-produced in large quantities, which makes it necessary to electrically test the finished plug-type connector. In known plug-type connectors, illustrated for example in FIG. 3, contacts are situated in a contact chamber of a housing for the plug-type connector, and are locked at least once by means of projecting clips, for example. The contact extends out of the housing on the side at which the contact is attached to a cable and electrically contacted. The contact of the plug-type connector is accessible to its counterpart in the mating connector on the opposite side, i.e. the plug-in side of the plug-type connector, at which the contact may be brought into a working connection with the mating contact. The electrical test is performed from this side by use of a contact test probe, and for function testing the contact test probe engages the contact on the end face of the contact, but not in the contacting zone of the contact. This known function testing has the disadvantage that large forces act on the contact, and the function testing can be used only for installed contacts. It is also necessary to place the contact test probe in an adapter that is attached to the housing so that the contact test probe is in precise axial alignment with the position of the contact for the plug-type connector.

OBJECT OF THE INVENTION

The object of the invention, therefore, is to provide a plug-type connector that avoids the previously described disadvantages. The primary aim in using such a plug-type connector is that the electrical function test can be performed easily, quickly, and reliably, and that the auxiliary means necessary for this purpose are economically manufacturable and durable.

SUMMARY OF THE INVENTION

According to the invention, the contact chamber in the housing has a test slot that receives a contact test probe, which for purposes of function testing of the plug-type connector may be inserted into the at least one contact chamber. The function testing may be carried out during the electrical testing for this type of plug-type connector as well. This ensures that the subsequent function of the plug-type connector, namely, the transmission of current or signals, occurs in a reliable manner so that, for example, poor electrical connections between the contact and the cable may be detected. In addition, the contact between the contact test probe and the contact is still made at the end face of the contact, and not in the contacting zone, thereby avoiding damage at that location during function testing. However, because of the test slot in the contact chamber in the housing according to the invention, it is no longer necessary for the contact test probe and the contact to be in precise axial alignment with one another (i.e. there is no need for the cross section of the contact in the plug-type connector to be completely covered by the cross section of the contact test probe). According to the invention, it is possible that the cross sections of the contact and the contact test probe only need to partially overlap, thereby allowing small contacting forces to be employed in the function testing during the electrical test. Furthermore, the greater allowable tolerances enable a more economical design for the adapter, since small tolerances are permissible for the adapter that accommodates the contact test probe and that for the function testing must be connected to the housing for the plug-type connector. In addition, the adapter tolerances are prevented from influencing the test results.

In one refinement of the invention, the test slot is situated on only one inner face in the contact chamber, on two inner faces in the contact chamber, and, in this case, preferably on two oppositely confronting inner faces in the contact chamber. This allows the contact test probe to have play inside the contact chamber during electrical function testing, thus enabling larger tolerances to be maintained.

In one refinement of the invention, a contact test probe is associated with a contact, the contact test probe being provided in an adapter that can be brought into working connection with the housing for function testing. This allows rapid function testing in which the adapter is brought into working connection with the housing for the plug-type connector (plugged in), the end face of the contact test probe pressing against the end face of the contact. This assembly may then be connected to an electrical test device to check, for example, whether in this case an electrical circuit is connected.

In one refinement of the invention, the plug-type connector has multiple contacts, in particular arranged in rows, for function testing each contact being brought into a working connection with a respective contact test probe. In other words, a number of contact test probes are present that correspond to the number of contacts in the plug-type connector in a row or in multiple parallel rows. This advantageously allows the electrical function of the particular plug-type connector to be quickly and reliably tested by use of a test adapter having correspondingly positioned contact test probes.

SPECIFIC DESCRIPTION

Figure 1:
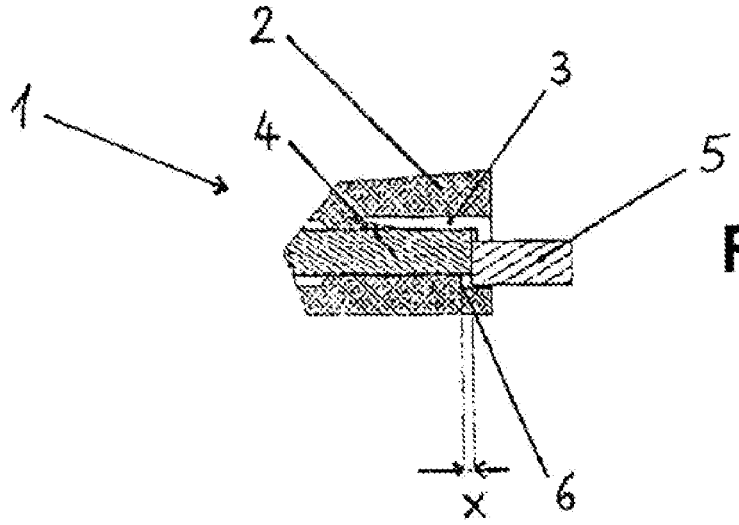
FIGS. 1 and 2 show embodiments of the invention.
Figure 2:
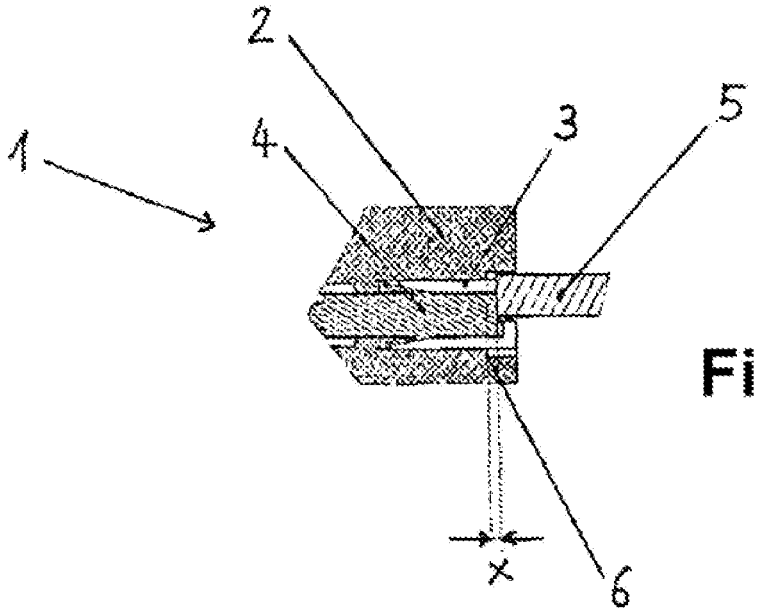
Figure 3:
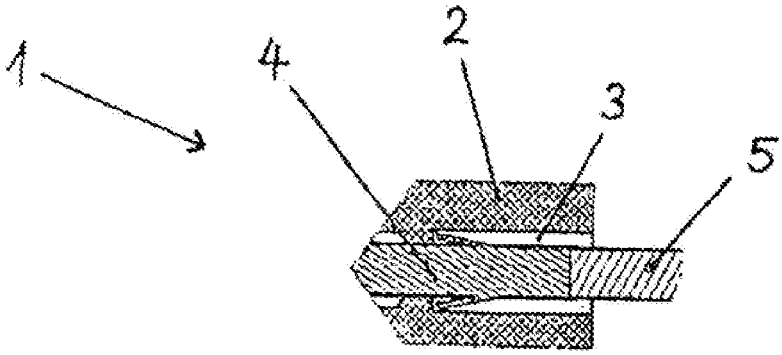
Fig. 3 Prior art
FIG. 3 shows a design according to the prior art.

FIGS. 1 and 2 show detailed sectional, schematic illustrations of a plug-type connector 1 having a housing 2 made of plastic. In the housing 2 at least one contact chamber 3 is provided in which a contact 4, in particular a socket contact, is fitted and locked, for example by means of projecting clips that are supported on a stop in the housing 2. FIG. 1 shows the socket contact with a primary contact lock on one side, while FIG. 2 shows the socket contact with a primary contact lock on both sides. A contact test probe, designated by reference numeral 5, may be moved a short distance into the contact chamber 3 until the contact test probe at its end face comes to rest on the end face of the contact 4, thereby establishing an electrical connection for electrical function testing. To provide the contact test probe 5 with greater freedom of motion in order to increase the permissible tolerances, in FIG. 1 a test slot 6 is provided on one side in the contact chamber 3 on only one inner face. In FIG. 2 this test slot 6 is situated on two inner faces, namely, on two oppositely situated inner faces of the contact chamber 3.

The correct position of the contact 4 inserted into the contact chamber 3 may be tested by means of a simple contact test probe 5 that is inserted through the test slot 6, to a limited depth in the axial direction, into the contact chamber 3 of the housing 2. The contact test probe 5 contacts the contact 4 in the testing window when the contact test probe has assumed the correct position within the contact chamber 3. If the contact 4 is not in the correct position within the contact chamber 3, the contact test probe 5 strikes the positioning surface in the test slot 6 and is no longer contacted. For a plug-type connector 1 according to FIG. 1 or 2, for example, this positioning surface is formed by the recess in which the test slot 6 merges into the housing 2. Thus, with reference to FIGS. 1 and 2, if the contact 4 is moved too far to the left over this recess (for example, because the locking clip was compressed), the contact test probe 5 is no longer able to form an electrical connection with the contact 4. Thus, the invention allows the correct position of the contact 4 within the contact chamber 3 in the housing 2 for the plug-type connector 1 to be determined by the positioning surface that forms the test slot 6.

Although only socket contacts having a planar end face are illustrated as the contact 4 in the figures, plug contacts may also be used in the invention, to which end the contact test probe must then be matched to the correspondingly shaped end face of the plug contact.

The invention claimed is:

1. A plug-type connector having a plastic housing having at least one contact chamber in which a contact is fitted and locked at least at one location wherein the contact chamber in the housing has on each of two inner faces of the contact chamber a test slot that can receive a test probe that is inserted into the contact chamber for a function test of the plug-type connector.

2. The plug-type connector according to claim 1 wherein test slots are provided on two confronting inner faces of the contact chamber.

3. The plug-type connector according to claim 1 wherein one contact is associated with a test probe that is provided with an adapter fittable with the housing for function testing.

4. The plug-type connector according to claim 1 wherein the plug-type connector has a plurality of contacts in a row, each contact being engageable for function testing with a respective test probe.

* * * * *